United States Patent [19]

Asakura

[11] 4,021,638

[45] May 3, 1977

[54] METHOD AND APPARATUS FOR THE DESTRUCTION OF AN UPPER PORTION OF A STRUCTURE

[76] Inventor: Kensuke Asakura, 1-29-16, Kinuta, Setagaya, Tokyo, Japan

[22] Filed: Sept. 18, 1975

[21] Appl. No.: 614,558

[30] Foreign Application Priority Data

Sept. 25, 1974 Japan ..... 49-109514

[52] U.S. Cl. ..... 219/200; 52/232; 52/396; 219/213

[51] Int. Cl.[2] ..... H05B 1/00

[58] Field of Search ..... 219/200, 213, 528, 548, 219/549, 544, 535; 52/DIG. 5, 232, 573, 396

[56] References Cited

UNITED STATES PATENTS 3,111,569 11/1963 Rubenstein ..... 219/549 X 3,662,951 5/1972 Smith et al. ..... 219/213 UX 3,924,103 12/1975 Furuishi et al. ..... 219/213 X

*Primary Examiner*—C. L. Albritton

*Attorney, Agent, or Firm*—Oblon, Fisher, Spivak, McClelland & Maier

[57] ABSTRACT

At least one heat destructive layer is embedded between an upper portion made of concrete and a lower portion made of concrete in a structure at the time of the construction of the upper portion of the structure. The heat destructive layer has at least one heating device and at least one heat destructive part made of plastic material or the like. Electric power is supplied to the heating device at the time of the destruction of the upper portion of the structure, whereby the heat destructive part is to be destroyed and easy destruction of the upper portion of the structure can be obtained.

10 Claims, 4 Drawing Figures

METHOD AND APPARATUS FOR THE DESTRUCTION OF AN UPPER PORTION OF A STRUCTURE

BACKGROUND OF THE INVENTION

This invention relates to a method and an apparatus for the destruction of an upper portion made of concrete and disposed on a lower portion made of concrete in a structure.

In the past, a method for the destruction of a concrete structure, in which electric power is supplied to the steel reinforcing rods to destroy the concrete portion of the structure, has been tested. But, the method cannot be practically used, because concrete structure is very strong. Therefore, in a case of destruction of a concrete structure, a great deal of labor and cost are consumed. Sometimes, noises created by destruction work become an environmental problem. For example, removing work of reinforced portions of a bridge for reattaching joints is very laborious and creates noises.

SUMMARY OF THE INVENTION

Accordingly, one object of this invention is to provide a method and an apparatus for the destruction of an upper portion made of concrete and disposed on a lower portion made of concrete in a structure, wherein easy and quick destruction of the upper portion of the structure can be obtained, thus reducing the labor, cost and noises involved in the destruction of the upper portion of the structure.

The foregoing and other objects are achieved by this invention through the provision of a method for the destruction of an upper portion made of concrete and disposed on a lower portion made of concrete in a structure comprising the steps of embedding at least one heat destructive layer which has at least one heating device and at least one heat destructive part between the lower portion and the upper portion of the structure at the time of the construction of the upper portion of the structure, and supplying electric power to the heating device at the time of the destruction of the upper portion of the structure, whereby the heat destructive part is to be destroyed. The heat destructive part of the heat destructive layer may be made of plastic adhesive material.

This invention also provides a structure having a lower portion made of concrete and an upper portion made of concrete and disposed an the lower portion. The structure has at least one heat destructive layer embedded between the lower portion and the upper portion at the time of the construction of the upper portion and includes at least one heating device and at least one heat destructive part which is destroyable by supplying electric power to the heating device. The structure may be a bridge which has a roadbed slab as the lower portion and a reinforced portion for attaching a joint as the upper portion.

BRIEF DESCRIPTION OF THE DRAWINGS

For more complete understanding of this invention reference should be made to the drawings, wherein.

DETAILED DESCRIPTION OF PREFERRED EMBODIMENTS

Figure 1:
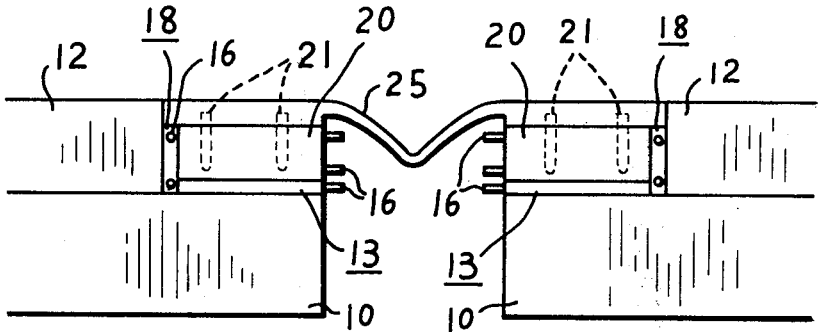
FIG. 1 is a side elevational view of a portion of a bridge using the invention.
Figure 2:
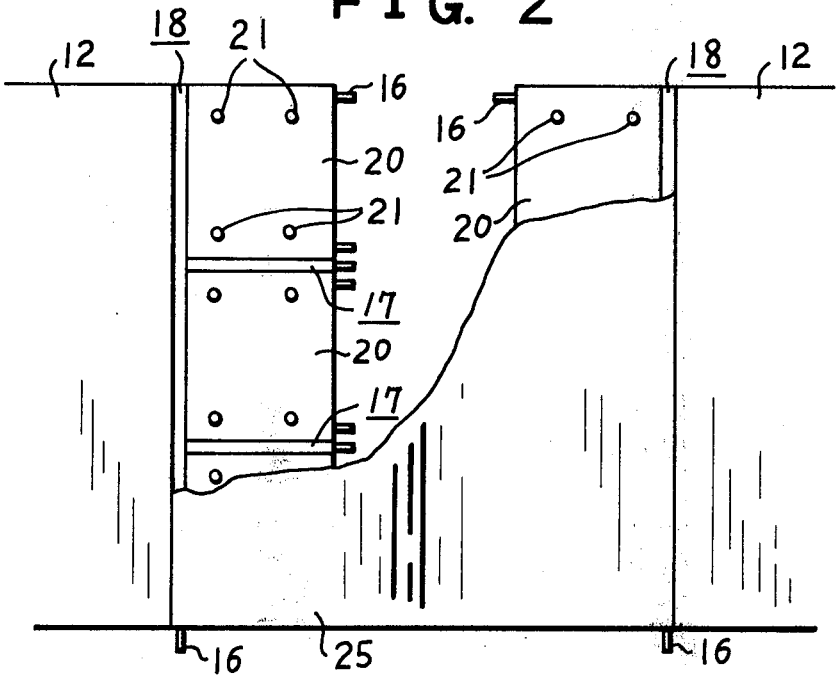
FIG. 2 is a plan view of the portion of the bridge shown in FIG. 1 partially cut-away.
Figure 3:
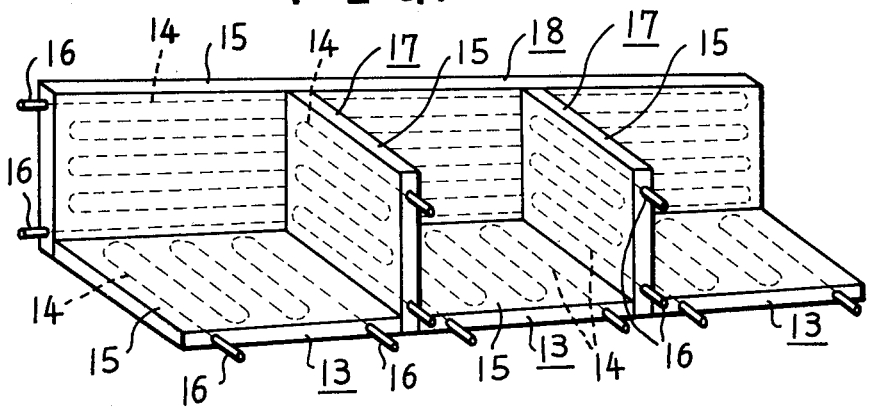
FIG. 3 is a perspective view of heat destructive layers embedded in one side of the portion of the bridge shown in FIGS. 1 and 2.

Referring now to the drawings, and more particularly to FIGS. 1 – 3 there is shown an embodiment of this invention applied to a structure for attaching a joint in a bridge.

A pair of roadbed slabs 10 made of concrete are spaced from each other longitudinally of the bridge to permit expansion of the slabs by heat. Surface layers 12 are formed by asphalt on the slabs 10 except adjacent end portions thereof.

Three heat destructive layers 13 are fixed onto each one of the adjacent end portions of the slabs 10. The heat destructive layer may be made in a factory as a heat destructive sheet, and it is composed of a heating device 14 which is a conductor such as Nichrome wire and a heat destructive part 15 made of plastic material. The heat destructive part 15 can be easily destroyed by supplying electric power to the heating device 14 from terminals 16, because the heat destructive part 15 is to be carbonized by heat conducted from the heating device 14.

Heat destructive layers 17 and 18, each one of which has the same composition as the heat destructive layer 13, are also provided. The heat destructive layers 17 are perpendicularly disposed on the slab 10 between each pair of adjacent portions of the heat destructive layers 13 and are parallel to each other. The heat destructive layer 18 is fixed to the end surface of the surface layer 12.

Reinforced portion 20 which is upwardly projected from the slab 10 is formed on each one of the heat destructive layers 13 by concrete and fixed to the adjacent heat destructive layers 13, 17 and 18 by adhesive material. The reinforced portion 20 may be provided with upwardly projected anchor bolts 21.

A joint 25 made of rubber or the like is attached onto the reinforced portions 20 at both sides thereof using the anchor bolts 21 and suitable adhesive material.

Usually, in a case of the exchange of the joint 25, the reinforced portions 20 have to be reconstructed. For the removal of the reinforced portions 20, electric power is supplied to the heating devices 14 of the heat destructive layers 13, 17 and 18, whereby the heat destructive parts 15 are to be destroyed. Thus, workers can easily remove the reinforced portions 20 by suitable tools in a short time.

In the above described embodiment, the heat destructive layers 17 and 18 may not be used. As the heating device of the heat destructive layer, bars or parallel disposed strips, a porous plate or a wire netting made of steel, copper, aluminum or the like can be used. It is possible to make the heat destructive layer directly at the position for use. For example, the heat destructive layer 13 can be made by disposing a heating device 14 and plastic adhesive material which is surrounding the heating device on the slab 10. The plastic adhesive material becomes the hard heat destructive part 15 after the reinforced portion 20 has been made. Instead of the plastic adhesive material, plastic concrete which is a mixture of sands and Epoxide or the like may be used.

Figure 4:
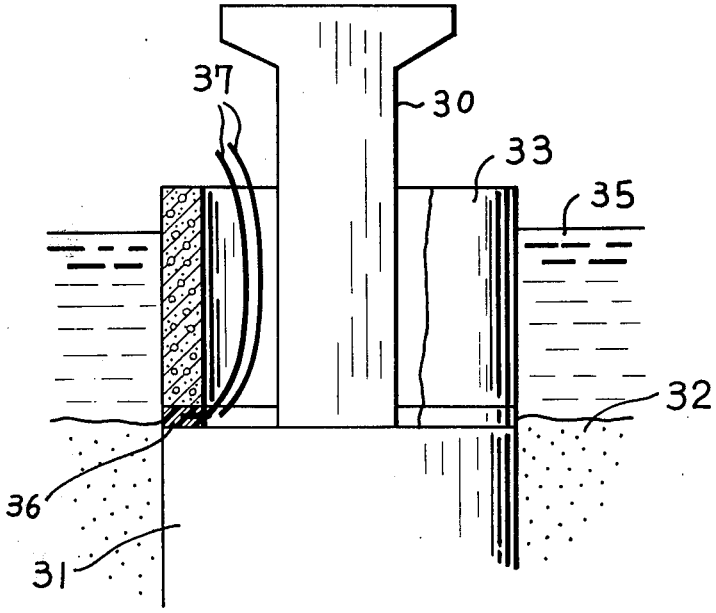
FIG. 4 is an elevational view of a pier of a bridge with a tubular concrete wall using the invention and partially cut-away.

In another embodiment of this invention shown in FIG. 4, a supporting pier 30 of a bridge has been erected on a caisson 31 embedded in the ground 32 by the method of pneumatic caisson. A tubular concrete wall 33 which is surrounding the pier 30 in water 35 has to be removed. An annular heat destructive layer 36 was made between the caisson 31 and the wall 33. Therefore, the wall 33 can be easily removed by supplying electric power to a heating device (not shown) of the heat destructive layer 36 through a pair of electric lines 37.

This invention also can be applied for removing of a concrete surface layer of a pavement for reconstruction thereof by embedding a heat destructive layer between the concrete surface layer and a roadbed slab of the pavement at the time of the construction of the concrete surface layer.

The method and the apparatus described above have a number of advantages, particularly in that easy and quick destruction of the upper portion of the structure can be obtained, whereby the labor, cost and noise involved in the destruction of the upper portion of the structure are reduced.

The foregoing is of course considered as illustrative only of the principle of the invention. Obviously, numerous modifications and variations of the present invention are possible in light of the above teaching.

What is claimed as new and desired to be secured by Letters Patent of the United States is:

1. In a structure having a lower portion made of concrete and an upper portion made of concrete and disposed on said lower portion, said structure comprising:

at least one heat destructive layer embedded between the lower portion and said upper portion at the time of the construction of said upper portion; and said heat destructive layer includes at least one heating device and at least one heat destructive part, said heat destructive part being destroyable by supplying electric power to said heating device.

2. A structure as set forth in claim 1, wherein:

said structure is a bridge having a roadbed slab as said lower portion and a reinforced portion for attaching a joint as said upper portion.

3. A structure as set forth in claim 1, wherein:

said structure is a structure for erecting a supporting pier of a bridge having a caisson as said lower portion and a tubular concrete wall which projects upwardly from said caisson as said upper portion.

4. A structure as set forth in claim 1, wherein:

said structure is a pavement having a roadbed slab as said lower portion and a concrete surface layer which covers the upper surface of said roadbed slab as said upper portion.

5. A structure as set forth in claim 1, wherein:

said heat destructive part is made of plastic adhesive material.

6. A method for the destruction of an upper portion made of concrete and disposed on a lower portion made of concrete in a structure comprising the steps of:

embedding at least one heat destructive layer, which has at least one heating device and at least one heat destructive part, between said lower portion and said upper portion at the time of the construction of said upper portion; and supplying electric power to said heating device at the time of the destruction of said upper portion, whereby said heat destructive part is destroyed so as to destroy said upper portion.

7. A method as set forth in claim 6, wherein:

said structure is a bridge having a roadbed slab as said lower portion and a reinforced portion for attaching a joint as said upper portion.

8. A method as set forth in claim 6, wherein:

said structure is a structure for erecting a supporting pier of a bridge having a caisson as said lower portion and a tubular concrete wall which projects upwardly from said caisson as said upper portion.

9. A method as set forth in claim 6, wherein:

said structure is a pavement having a roadbed slab as said lower portion and a concrete surface layer which covers the upper surface of said roadbed slab as said upper portion.

10. A method as set forth in claim 6, wherein:

said heat destructive part is made of plastic adhesive material.

* * * * *